US005147236A

United States Patent [19]

Hartman

[11] Patent Number: 5,147,236

[45] Date of Patent: Sep. 15, 1992

[54] WHIRLIGIG WITH ARTICULATED FRAME

[76] Inventor: Richard B. Hartman, 7516 201st SE, Issaquah, Wash. 98027

[21] Appl. No.: 726,986

[22] Filed: Jul. 8, 1991

[51] Int. Cl.[5] ..... A63H 1/32

[52] U.S. Cl. ..... 446/253; 446/330

[58] Field of Search ..... 446/253, 254, 486, 321, 446/320, 214, 322, 323, 330; 272/68

[56] References Cited

U.S. PATENT DOCUMENTS

| | | | |
|---|---|---|---|
| 70,610 | 11/1867 | Porter | 446/253 |
| 97,850 | 12/1869 | Able | 446/253 |
| 105,792 | 7/1870 | Franke | 446/253 X |
| 382,744 | 5/1888 | Weber | 446/253 X |
| 846,449 | 3/1907 | Brimmer | 446/323 |
| 1,059,886 | 4/1913 | Loomis | 446/253 X |
| 1,660,735 | 2/1928 | Wilson | 446/320 |
| 3,721,037 | 3/1973 | Allen | 446/62 |
| 3,789,545 | 2/1974 | Mann | 446/62 |
| 4,911,447 | 3/1990 | Pickard | 273/141 R |

OTHER PUBLICATIONS

*American Folk Toys-How To Make Them*, by Dick Schnacke 1973 pp. 18-19.

*Primary Examiner*—Mickey Yu

[57] ABSTRACT

Levered whirligig of the string torsion variety which employs the forces generated by contraction of string torsion device (26) to actuate an articulated frame (10). Articulated frame (10) includes levers (12) and upper struts (18). Levers (12) including handles (16), fulcrums (11) lower struts (14) and hooking member (22) with notches (24). Upper and lower struts are joined together at hinged joints (20), thereby providing an enclosed, articulated frame easily manipulated using a variety of methods. String torsion device (26) includes intertwistable strands (28) and spinning member (30).

6 Claims, 3 Drawing Sheets

WHIRLIGIG WITH ARTICULATED FRAME

BACKGROUND

1. Field of Invention

This invention relates to a novelty amusement device, specifically, an improved lever-type whirligig of the string torsion variety incorporating an articulated frame.

2. Discussion of Prior Art

Whirligigs of the string torsion variety, sometimes known as "button-buzzer," have been popular playthings for children and adults for over 100 years. In their simplest form, a length of string is threaded through two diagonally opposing holes in a common button and tied into a loop; this loop is then gently stretched between the player's two hands, while the button is simultaneously spun around its axis, thereby causing the strands of string in the loop to become intertwisted. By alternately pulling his or her hands apart with greater force and then relaxing the tension, a player can cause the strands of string and consequently, the button, to untwist and then twist in the opposite direction.

Dozens of variations of string torsion devices can be found in the prior art. Most of these variations focus on modifications to the "button," or spinning member, of the toy. U.S. Pat. No. 70,610 to Porter (1867) for example, describes an early form of the toy incorporating a hollow, metal disk that emits whistling sounds when spun upon its string. U.S. Pat. Nos. 105,792 to Franke (1870); 3,721,037 to Allen (1973); 3,789,545 to Mann (1974) and 4,911,447 to Pickard (1990) describe, respectively, spinning members which: change color, animate pictures, detach to become free-spinning tops, and randomly select numbers or words as in a roulette wheel.

Less-common in the prior art are examples of string torsion whirligigs that focus on innovative means for holding and alternately tensing and relaxing the intertwistable strands of string or cord of the toy. One method, suggested in U.S. Pat. No. 846,449 to Brimmer (1907) involves a resilient hoop which distorts and exerts horizontal tension upon a modified string torsion device when vertical pressure is exerted on the resilient hoop by means of a complicated string and lever assembly. Brimmer's invention requires a cumbersome base structure for mounting, does not accommodate string torsion devices of the "button-buzzer" variety, and is deficient in several other structural features of the present invention which will be apparent from the detailed description of a preferred embodiment and the appended claims to follow. One of the more intriguing and efficient methods for manipulating a button-buzzer type whirligig involves the addition of rigid, hinged levers resembling forceps, which, when squeezed together at one end, spread apart at their opposite ends, creating the tension required to activate the string torsion device of the toy. U.S. Pat. Nos. 97,850 to Able (1869) and 382,744 to Weber (1888) disclose examples of this variation and have the advantage over most other string torsion whirligigs of enabling a player to operate his or her toy with one, instead of two, hands.

However, these lever-type whirligigs suffer from a number of disadvantages and limitations, a primary disadvantage and limitation being that they limit the number of methods which can be used to cause the string torsion device of the toy to alternately expand and contract; repeatedly squeezing and releasing one's grip on the levered handles of these devices can to become tiring, repetitive, and monotonous for the player, thereby diminishing fascination in the toy. Another related disadvantage and limitation of previously disclosed whirligigs in this category is that they generally do not permit rigging of the string torsion device along a vertical axis when the toy is held in its upright position. A third disadvantage and limitation of previously disclosed toys in this category is that they fail to fully exploit and utilize the considerable inwardpulling forces generated by the string torsion device as it repeatedly contracts and expands.

None of the prior art inventions cited above anticipates a structure whereby two or more pivotally coupled, rigid struts would be pivotally affixed to the ends of the levers in a lever-type whirligig, thereby forming an enclosed articulated frame which provides additional sturdiness, creates increased visual appeal and allows for a variety of methods of operation and configurations of play. U.S. Pat. No. 1,660,735 to Wilson (1922) discloses an enclosed articulated frame; however, Wilson's invention, which discloses a frame for adjusting the shape of a doll's head, includes no string torsion device and no handles for holding and distorting the shape of the frame. Additionally, none of the prior art inventions cited above anticipates a structure whereby the entire enclosed articulated frame described above is mounted on additional intertwistable strands, which, when tensed, cause the frame itself to spin alternately in one direction and then the other, thereby creating a nested, lever-type whirligig.

Therefore it can be seen that there remains a need for a lever-type whirligig of the string torsion variety incorporating an enclosed articulated frame that enables the player to operate the toy in a variety of ways; that permits a configuration in which the intertwistable strands are rigged along vertical axis when the toy is upright; that invites wholly new configurations, whereby the tension created by the contracting string torsion device can be harnessed to actuate a wide variety of animated shapes; that provides greater sturdiness, visual appeal and variety of methods of operation than toys previously disclosed in this category; and that permits a configuration where a nested, lever-type whirligig can be created by mounting an articulated whirligig frame on separate intertwistable strands.

OBJECTS AND ADVANTAGES

Accordingly, the objects and advantages of my invention are to provide a lever-type whirligig including an enclosed articulated frame:

(a) that offers a variety of methods for operations;

(b) that permits a configuration in which the string torsion device can be rigged along a vertical axis when the toy is upright;

(c) that invites wholly new configurations in which the forces generated by the alternate expanding and contracting of the string torsion device can be harnessed to actuate a wide variety of animated shapes;

(d) that provides greater sturdiness, visual appeal and variety of methods of operation than toys previously disclosed in this category; and (e) that permits a configuration where a nested, lever-type whirligig is created by mounting an enclosed articulated frame and string torsion device on separate intertwistable strands.

Further objects and advantages of my invention will become apparent from a consideration of the drawings and ensuing description of it.

REFERENCE NUMERALS IN DRAWINGS

Figure 1:
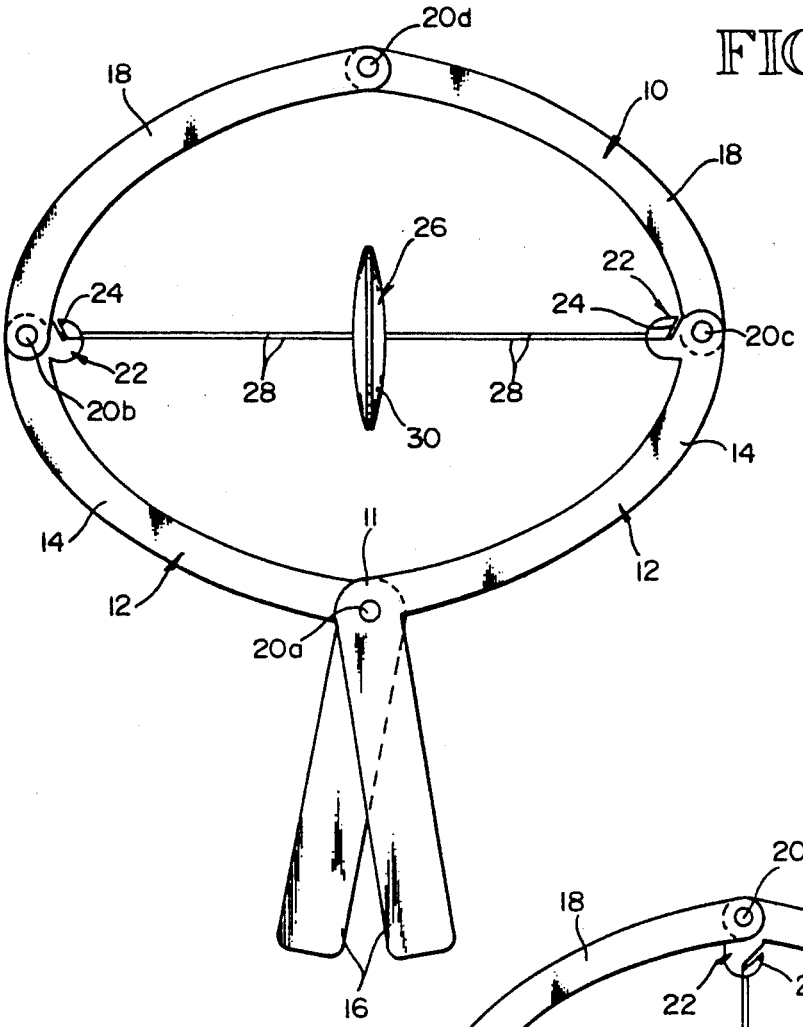
FIG. 1 is a view of a lever-type whirligig with an articulated frame, in accordance with the invention.

10 articulated frame
12 lever
16 handle
20 hinged joint
24 notch
28 intertwistable strands
11 fulcrum
14 lower strut
18 upper strut
22 hooking member
26 string torsion device
30 spinning member

DESCRIPTION—FIGS. 1, 2, 3, 4, 5

FIG. 1 shows a view of a preferred embodiment of my invention. An articulated frame 10 is comprised of two levers 12 and two upper struts 18. Each lever 12 in this embodiment is comprised of handle 16, a fulcrum 11, a lower strut 14, and a hooking member 22 with notch 24. Levers 12 are joined at fulcrums 11 by hinged joint 20*a*. The top ends of lower struts 14 are joined to the bottom ends of upper struts 18 at hinged joints 20*b* and 20 *c*. Upper struts 18 are joined together at their top ends at hinged joint 20*d*. A string torsion device 26 is comprised of a spinning member 30 mounted on intertwistable strands 28 which are rigged through notches 24 in hooking member 22.

Levers 12 and upper struts 18 may be crafted in wood, metal, plastic or any other rigid material and should be of sufficient thickness to assure the rigidity of each member. Hinged joints 20 may be in the form of standard metal rivets, or may be derived from other materials such as plastic. Additionally, snap-type hinged joints 20 may be molded directly into upper struts 18 and levers 12 so as to facilitate assembly. Hinged joint 20 must at once be tight enough to firmly hold each strut together, and loose enough to allow a free and smooth bending at each hinged joint.

The intertwistable strands 28 of string torsion device 26 should be non-elastic, should have sufficient strength and durability to withstand rigorous play, and may be made of nylon, cotton, plastic or any other flexible, cord-like material. Spinning member 30 may be made from any suitable material and may be crafted in the form of a disk, a wheel, a sphere, or any other shape which can be mounted, balanced and spun upon intertwistable strands 28.

Figure 2:
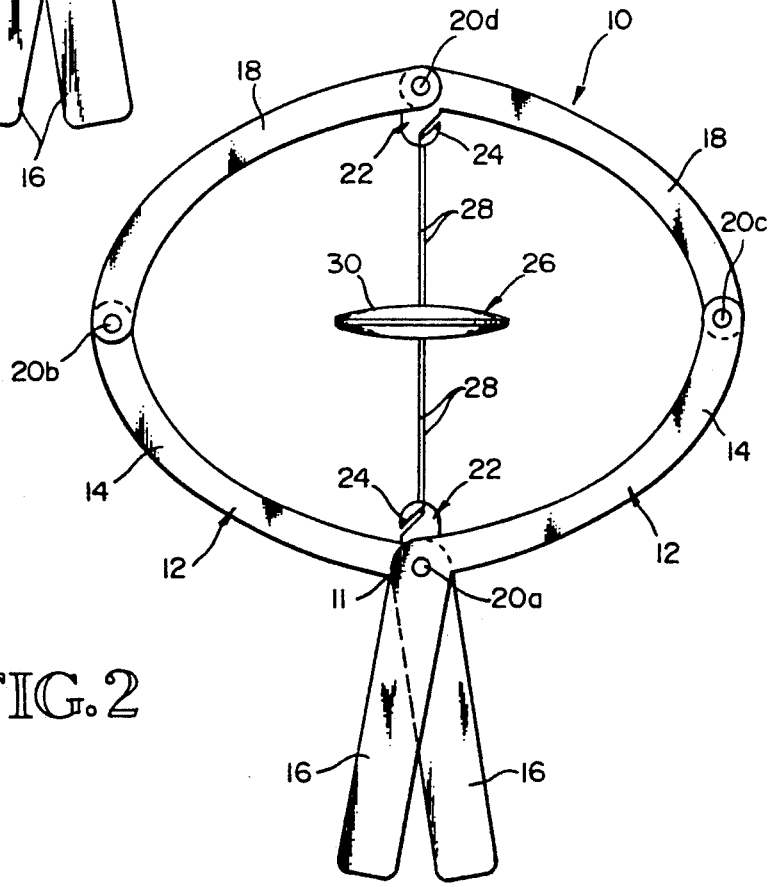
FIG. 2 is a view of one particular embodiment of the present invention showing a string torsion device rigged along a vertical axis when the toy is upright.

FIG. 2 shows a view of another embodiment of the present invention in which string torsion device 26 is rigged along a non-horizontal axis with the toy in its upright position.

Figure 3:
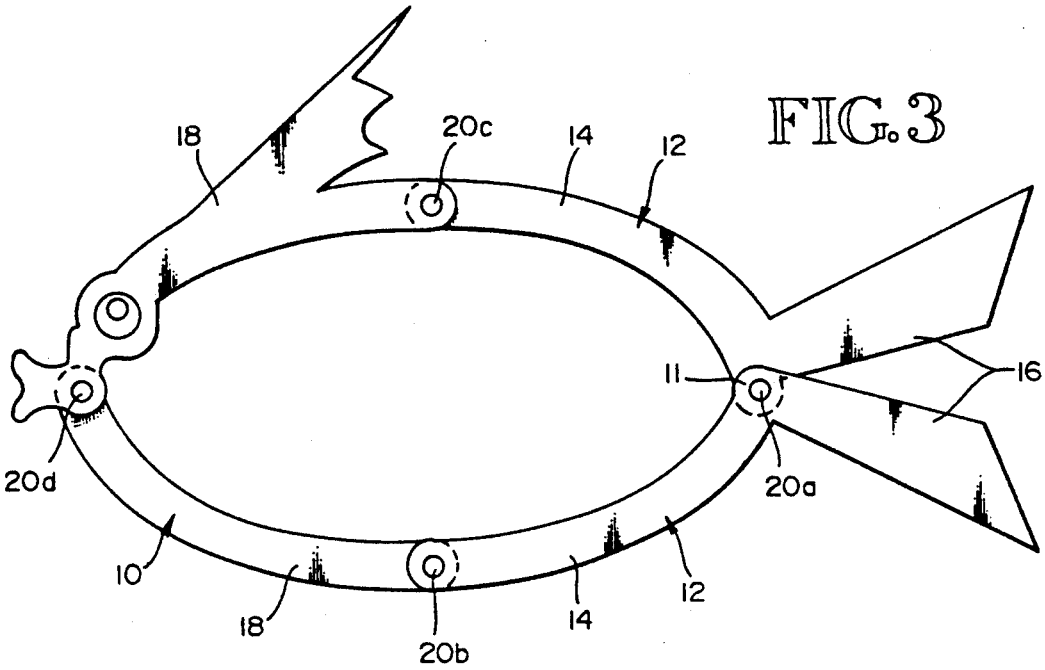
FIG. 3 is a view of another embodiment of the articulated frame in the present invention, in which the articulated frame is adapted to resemble a fish.
Figure 4:
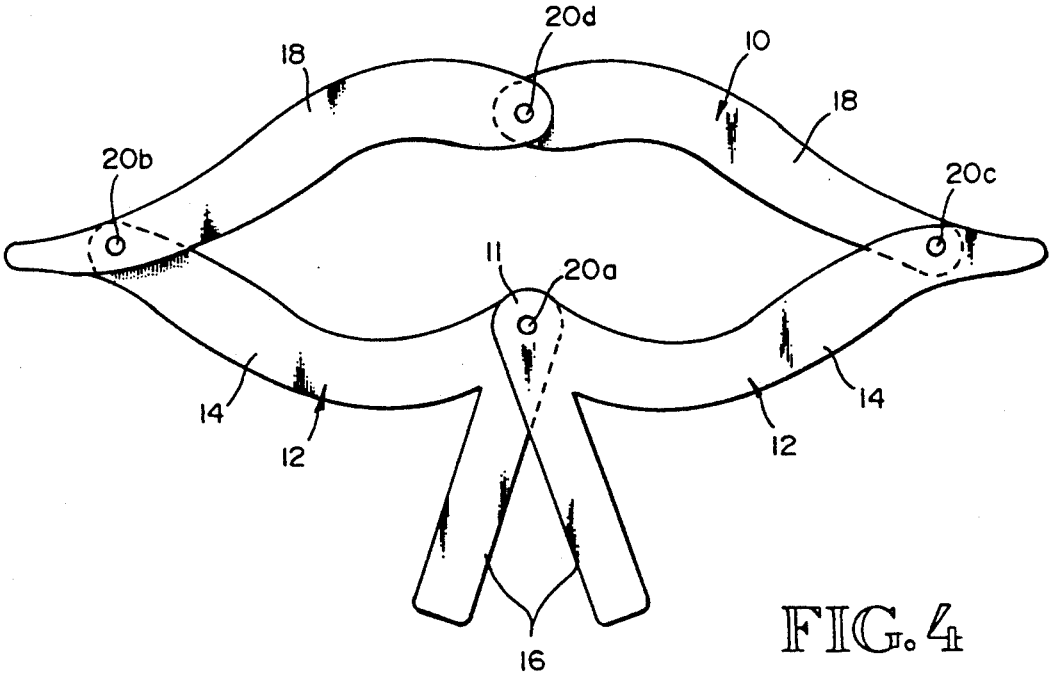
FIG. 4 is a view of yet another embodiment of the articulated frame of the present invention, in which the articulated frame is adapted to resemble a pair of human lips.

FIGS. 3 and 4 show further embodiments of the articulated frame of my invention, in which the levers 12 and upper struts 18 are modified so as to give articulated frame 10 the overall shape and appearance of a fish and a pair of human lips, respectively.

Figure 5:
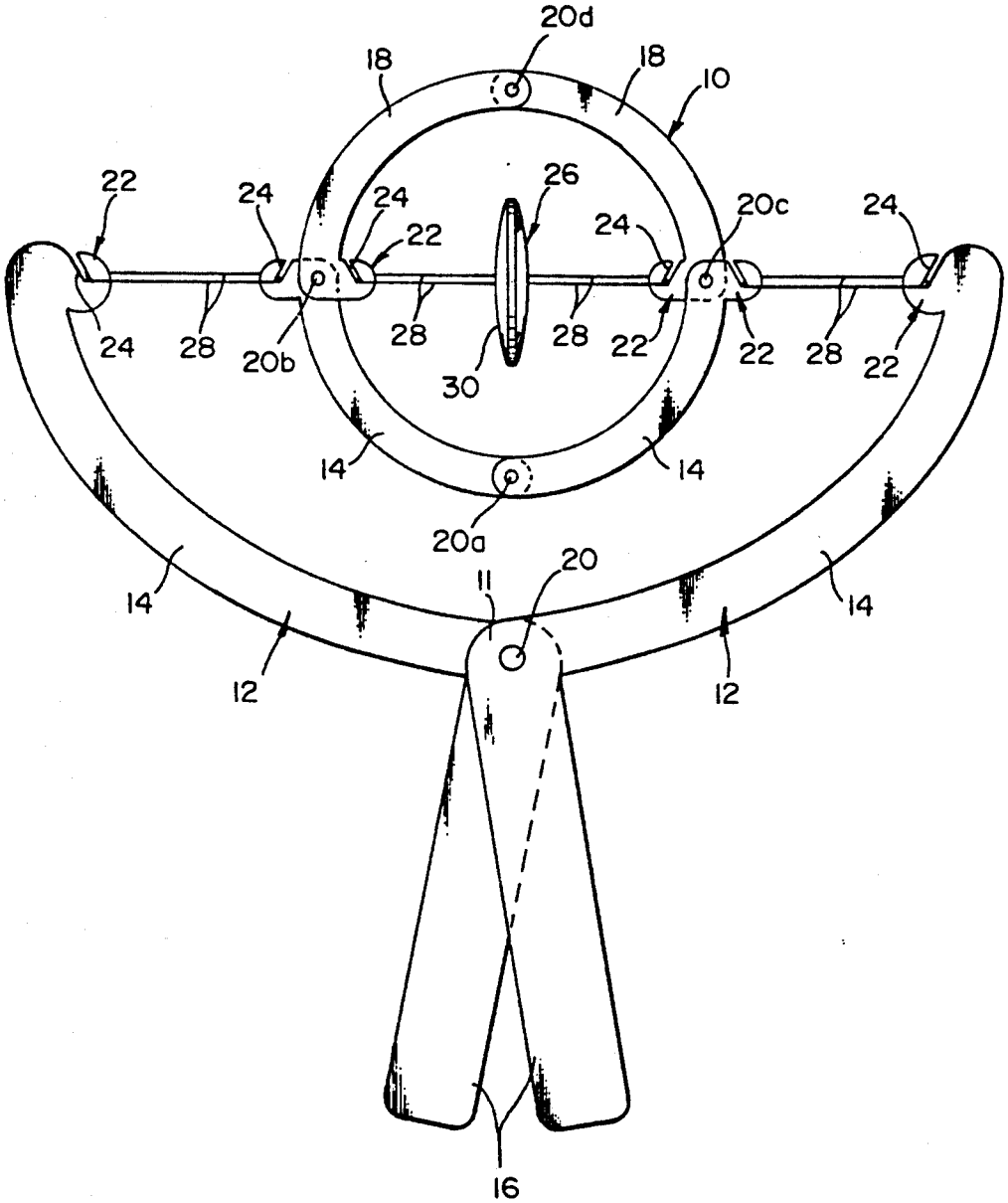
FIG. 5 is a view of another embodiment of my invention showing an articulated frame with string torsion device mounted on a set of levers to create a nested, lever-type whirligig.

FIG. 5 shows yet another embodiment of my invention, in which articulated frame 10 is modified so as to eliminate handles 16 and is rigged to levers 12 via additional sets of intertwistable strands 28, creating a nested string torsion device, or whirligig-within-a-whirligig.

From the description above, a number of advantages of my invention become evident:

(a) An enclosed articulated frame enables a player to generate the tension required to pull outwardly on the ends of a string torsion device in new and unusual ways, for example, by standing the whirligig upright, resting its handles on a hard surface, and exerting downward pressure upon the top of the toy (at hinged joint 20*d*.)

(b) A completely enclosed, articulated frame allows a string torsion device to be rigged along a vertical axis in relation to the toy when it is held in its upright position, thereby producing novelty.

(c) An enclosed articulated frame suggest configurations in which the visual appeal and entertainment value of a lever-type whirligig can be enhanced by creating colorful, animated shapes that pulse and contort as the string torsion device operates.

(d) An enclosed articulated frame permits a configuration in which a nested, lever-type whirligig is produced by rigging and spinning an enclosed articulated frame with string torsion device upon additional sets of intertwistable strands, thereby producing novel effects, such as the impression of a planetary ring swirling about a revolving orb.

(e) The addition of upper struts increases the overall sturdiness of the toy over previous disclosures, thereby leading to a more durable, longer-lasting product.

(f) The materials used in my invention are common and readily available and my design is relatively simple, easy to assemble and inexpensive to produce.

OPERATION—FIGS. 1, 2, 3, 4; 5

Methods of operations of my invention are similar for the embodiments shown in FIGS. 1, 3, and 4. To begin play, articulated frame 10 is gripped at handles 16, which are adjusted in relationship to one another so that intertwistable strands 28 of string torsion device 26 are slightly slackened. By manually turning spinning member 30 in one's free hand, or by rolling spinning member 30 against a semiresilient surface such as one's pant leg, or by gently rocking the entire whirligig so as to cause spinning member 30 to begin to spin, play is initiated. The initial turns of spinning member 30 cause intertwistable strands 28 to wrap around each other. Squeezing handles 16 together causes the top ends of lower struts 14, and, consequently, hinged joints 20*b* and 20*c*, to move farther apart in relation to each other, thereby causing hooking members 22 and notches 24 to also move farther apart in relation to one another. This exerts increased, outward tension on string torsion device 26, causing intertwistable strands 28 to unwrap at a high speed towards their original parallel positions in relation to one another. Momentum generated by high speed turning of spinning member 30 causes intertwistable strands 24 to twist beyond their parallel state in the direction opposite the initial spin. This motion results in the shortening of the relative length of string torsion device 26, which in turn exerts inwardly-pulling tension upon hooking members 22 and notches 24. This affects the entire shape of articulated frame 10 in that hinged joints **20*b* and 20*c* are drawn together in relation to one other, while hinged joints 20*a* and 20*d* are spread apart in relation to one another. By alternately squeezing and relaxing his or her grip on handles 16 in conjunction with the winding and unwinding cycles of string torsion device 26, a player can manipulate articulated frame 10** so as to produce pulsing, undulating movements of the toy.

Numerous other methods of operation can be achieved once a player perfects the basic operations described above. For example, while string torsion device 26 is alternately contracting and expanding, a player can stand the whirligig upright, resting its handles on a smooth, hard surface, and exert downward pressure upon the top of the toy at hinged joint **20*d* and then relax the pressure, thereby causing handles 16** to alternately spread apart and draw together in relation to one another. This produces an amusing, dancelike affect. Other tricks and pleasing affects are naturally discovered as a player continues to explore the operation of the toy.

Operation of the embodiment of my invention shown in FIG. 2 is similar, although it should be noted that squeezing handles 16 together causes hinged joints **20*b* and 20*c* to move together in relationship to one another, and hinged joints 20*a* and 20*d* to move apart in relation to one another, thereby creating the tension required to operate string torsion device 26** along its vertical axis.

Operation of the embodiment of my invention shown in FIG. 5 is achieved in a similar manner as the operations described for FIGS. 1, 3 and 4, except increased skill is required to achieve the desired affect: By squeezing and relaxing one's grip upon handles 16 at carefully-timed intervals, a player can achieve the desired goal of having the entire articulated frame 10 spin end over end upon additional intertwistable strands 28 while spinning member 30 of string torsion device 26 continues to revolve. This produces the affect of a nested, lever-type whirligig.

SUMMARY, RAMIFICATIONS AND SCOPE

Accordingly, the reader will see that, when operated, my invention provides for a lever-type whirligig with an enclosed articulated frame that offers a variety of methods of operation; permits a string torsion device that lies along a vertical axis when the toy is held upright; and employs the previously-unexploited forces generated by the contraction of a string torsion device to actuate colorful and uniquely-shaped frames such as the outline of a human mouth, or a fish.

Additionally, my invention provides for greater sturdiness over previous toys in this category and anticipates a variation in which a nested, lever-type whirligig can be produced.

Although the description above contains many specificities, these should not be construed as limiting the scope of the invention but as merely providing illustrations of some of the presently preferred embodiments of this invention. For example, numerous other shapes for the articulated frame are anticipated, including the outline of a heart (which "throbs" as the string torsion device expands and contracts), a butterfly or bird (which "flaps"), a human face (that "squints"), and rabbit ears (which "wiggle.") Additionally, hooking members and string notches as described above could be modified to form a simple hook or notch used to anchor the intertwistable strands to the lower struts of my invention's preferred embodiment.

Thus the scope of the invention should be determined by the appended claims and their legal equivalents, rather than by the examples given.

I claim:

1. A spinning toy comprising:

(a) a string torsion device comprising a spinning member and a plurality of intertwistable strands, said spinning member being mounted on said plurality of intertwistable strands providing rotating means for rotating said spinning member at a high velocity in alternating directions when said intertwistable strands are alternately tensed and relaxed;

(b) an enclosed articulated frame comprising a plurality of rigid struts, each one of said rigid struts being pivotally joined at each end there of to another one of said rigid struts to form said enclosed articulated frame, said enclosed articulated frame providing attaching means for engaging ends of said string torsion device, whereby said string torsion device spans said enclosed articulated frame;

(c) said enclosed articulated frame providing means for employing contracting force of said string torsion device to distort said enclosed articulated frame.

2. A spinning toy in accordance with claim 1 further including a plurality of handles attached to two struts of said enclosed articulated frame, whereby a shape of said enclosed articulated frame may be distorted by moving said handles relative to each other.

3. A spinning toy in accordance with claim 2 wherein said enclosed articulated frame is adapted to resemble a shape of an animated figure, whereby said shape of said animated figure appears to contract and expand as pressure is alternately exerted on and released from said handles.

4. A spinning toy in accordance with claim 2 wherein said enclosed articulated frame provides means for rigging said string torsion device along a vertical axis with said articulated frame in an upright position.

5. A spinning toy in accordance with claim 1 further including additional intertwistable strands, and means on said enclosed articulated frame for mounting said additional intertwistable strands, said additional strands providing means for spinning said enclosed articulated frame upon said additional intertwistable strands independent of said string torsion device.

6. An improved spinning toy comprising a string torsion device and an enclosed articulated frame, said string torsion device providing contracting means for exerting inwardly directed pressure on said enclosed articulated frame, said enclosed articulated frame comprising two rigid upper struts each having a top end and a bottom end, and two rigid levers, each one of said rigid levers comprising a lower strut having a top end and a bottom end, a fulcrum and a handle, said rigid levers joined together at said fulcrum by a hinged joint, the top ends of said lower struts joined to the bottom ends of said rigid upper struts by hinged joints, the top ends of said rigid upper struts joined together by a hinged joint, said handles providing means for gripping said handles, whereby pressure alternately exerted and relaxed upon said handles causes said enclosed articulated frame to expand and contract as said string torsion device expands and contracts.

* * * * *